US006308756B1

(12) United States Patent
Anttila

(10) Patent No.: US 6,308,756 B1
(45) Date of Patent: Oct. 30, 2001

(54) DUAL ALTERNATING TRANSVERSE FEEDING MECHANISM FOR LUMBER EDGERS

(75) Inventor: Aki J. Anttila, Portland, OR (US)

(73) Assignee: The Coe Manufacturing Company, Portland, OR (US)

( * ) Notice: Subject to any disclaimer, the term of this patent is extended or adjusted under 35 U.S.C. 154(b) by 7 days.

(21) Appl. No.: 09/594,326

(22) Filed: Jun. 14, 2000

Related U.S. Application Data

(63) Continuation of application No. 09/177,718, filed on Oct. 23, 1998, now abandoned.

(51) Int. Cl.[7] ..... B27B 31/00

(52) U.S. Cl. ..... 144/245.1; 83/435.18; 144/242.1; 144/378; 144/357; 198/464.2; 198/468.2

(58) Field of Search ..... 144/242.1, 245.1, 144/245.4, 245.5, 250.2, 250.21, 256.23, 356, 357, 378; 83/13, 471.1, 471.3, 370, 404.2, 708, 468.11, 365, 367, 435.18; 198/468.2, 468.6, 468.9, 464.2; 250/559.2, 559.21, 559.4; 356/631, 634

(56) References Cited

U.S. PATENT DOCUMENTS

| | | | | |
|---|---|---|---|---|
| 1,838,780 | * | 12/1931 | Miller et al. | 144/245.5 |
| 2,996,167 | * | 8/1961 | Amicis et al. | 198/464.2 |
| 3,665,982 | * | 5/1972 | Kvalheim | 83/404.2 |
| 4,100,950 | * | 7/1978 | Stearns . | |
| 4,429,784 | * | 2/1984 | Cromeens | 144/245.1 X |
| 4,462,443 | * | 7/1984 | Allen | 144/245.1 |
| 4,489,635 | * | 12/1984 | Cooper | 83/708 |
| 4,803,371 | * | 2/1989 | Durland | 250/559.2 |
| 4,949,769 | * | 8/1990 | Cameron | 144/45.2 |
| 5,011,001 | * | 4/1991 | Cameron | 198/468.2 |
| 5,052,885 | * | 10/1991 | Foster | 198/468.7 |
| 5,165,518 | * | 11/1992 | Dietz | 144/245.1 X |
| 5,249,491 | * | 10/1993 | Carter | 83/13 |
| 5,299,610 | * | 4/1994 | Sentagnes et al. | 144/370 |
| 5,385,186 | * | 1/1995 | Head, Jr. et al. | 144/245.2 |
| 5,617,910 | * | 4/1997 | Hill | 144/356 |
| 5,694,993 | * | 12/1997 | Cameron | 144/245.1 |
| 5,853,038 | * | 12/1998 | Newnes | 144/357 |

* cited by examiner

*Primary Examiner*—W. Donald Bray
(74) *Attorney, Agent, or Firm*—Klarquist Sparkman, LLP

(57) ABSTRACT

A lumber feeding mechanism for feeding lumber pieces laterally on a supply conveyor after scanning them with a light scanner to determine a reference axis for the optimum yield of boards. The lumber pieces are fed by dogs from a start position to a feed position in alignment with a feed conveyor which feeds such pieces longitudinally through a lumber edger with adjustable cutting saws. The feeding mechanism includes alternating sets of first and second dogs which are pivoted between a raised position for engagement with the rear edges of the lumber pieces to push such pieces from the start position to the feed position and a retracted position to enable the dogs to be returned to the start position passing on opposite sides or on the same side of the piece. Electrical actuation motors or fluid cylinder actuation motors with rotating output gears are used to pivot the dogs in response to a control signal produced by an electrical control system. The dogs are moved between the start position and the feed position along guides by drive cylinders and the lumber pieces are engaged by air stop cylinders as the pieces are moved toward the feed position to accurately position such pieces at the feed position where they are engaged by hold-down rolls and fed by the feed conveyor through the lumber edger.

20 Claims, 8 Drawing Sheets

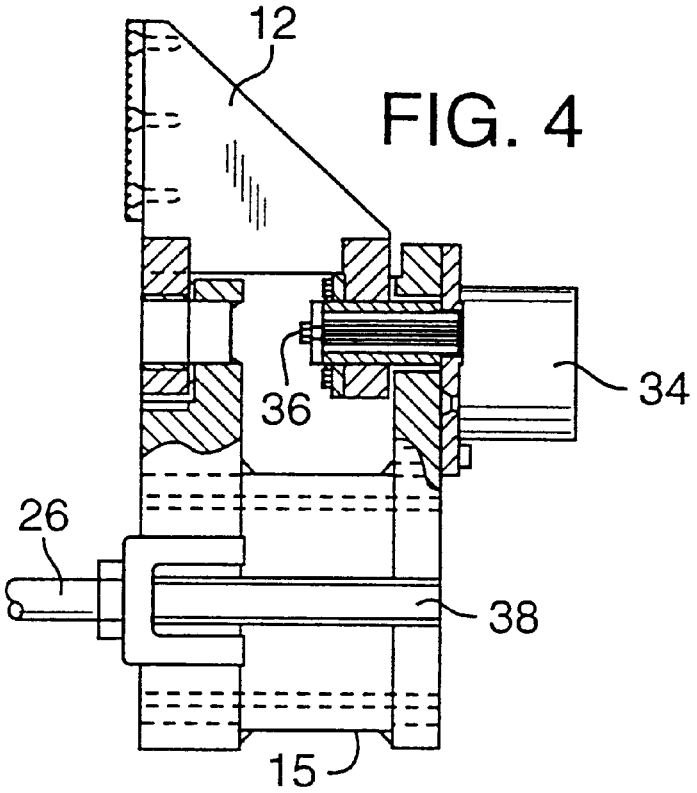
FIG. 4
FIG. 5
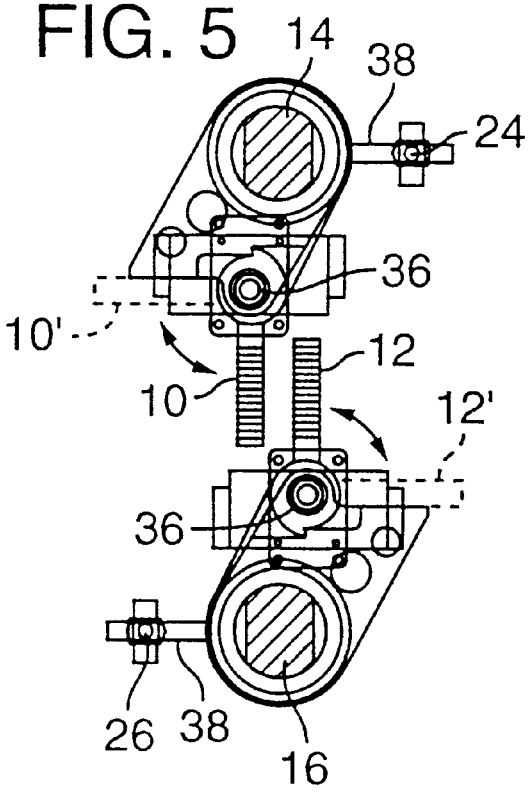
FIG. 3
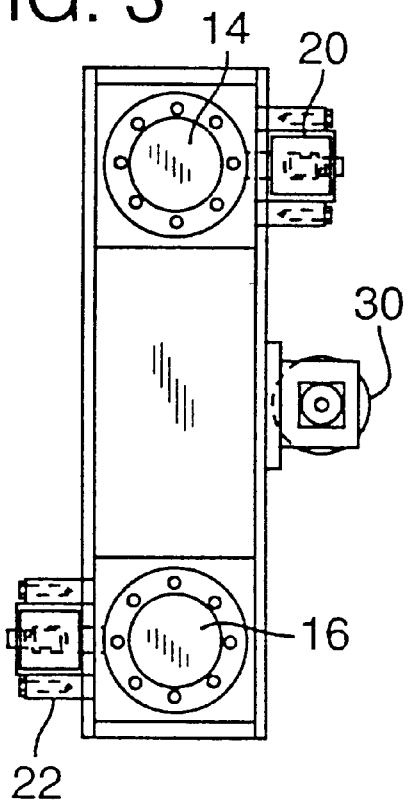

D* TEC LIGHT SCANNER
SCAN DATA
D* TEC OPTIMIZING COMPUTER
BOARD LENGTH, WIDTH, SETWORKS, TARGETS & THICKNESS
CONVEYOR TACHOMETER
FLOW
PLC SEQUENCE CONTROL
SET WORKS MOTION COMMANDS
SET WORKS MOTION CONTROLLER
ADJUSTABLE EDGER SAWS
FLOW
18
56
58
60
52
18
62
64
54
18
66
88
90
68
70
34
71
12
12
78
88
32
32
34
18A
10
10
18B
28
84
86
24
24
31
26
30
30
26
82
80
20
20
80
74
72
72
22
74
22
76
76
76
76

DUAL ALTERNATING TRANSVERSE FEEDING MECHANISM FOR LUMBER EDGERS

REFERENCE TO RELATED APPLICATION

The present patent application is a Continuation of U.S. patent application Ser. No. 09/177,718 filed Oct. 23, 1998, now abandoned.

BACKGROUND OF THE INVENTION

The subject matter of the present invention relates generally to dual alternating transverse feeding mechanisms including a set of first dogs and a set of second dogs for conveying lumber pieces, or flitches, cut from a log and having at least one flat surface and more commonly having opposed flat surfaces on their top and bottom faces, laterally on a supply conveyor after they pass through a light scanner to determine their optimum yield reference axis, from a start position to a feed position aligned with a feed conveyor for longitudinally conveying the lumber pieces through a lumber edger cutting device to cut the edges from such pieces to provide the optimum yield of boards. One embodiment of the present invention relates to such a feeding mechanism for a lumber edger in which the first and second dogs may be mounted for alternatively conveying successive lumber pieces from the start position to the feed position and for returning from the feed position to the start position on opposite sides of the next lumber pieces to enable faster and more efficient operation of the feeding mechanism. Such feeding mechanism may include actuating motors with rotatable output gears which are employed to pivot the dogs between a raised, or extended, position for engagement with the lumber pieces and a retracted position to enable return of the dogs from the feed position to the start position. Such actuating motor may be an electric motor which moves with the dog to which it is connected to provide a simple, compact and trouble-free actuating mechanism for pivoting the dogs.

The feeding mechanism of the present invention includes a pair of drive cylinders and guides for moving the first and second dogs which are mounted side-by-side to provide a compact and strong drive mechanism for moving lumber from the start position to the feed position. In addition, such drive mechanism may also employ an air stop cylinder which engages the lumber piece, or flitch, as it is conveyed toward the feed position by the dogs to engage and stop such piece at the feed position and thereby position the lumber piece in alignment with the feed conveyor in a faster and more accurate manner.

It has previously been proposed in U.S. Pat. No. 1,838,780 of Miller et al., issued Dec. 29, 1931, to provide an automatic feeding machine for feeding lumber to a resaw machine or edger by using alternating dogs which engage successive lumber pieces and are moved by an air cylinder to feed the pieces to the resaw machine when the dogs are in a raised position and which allows the dogs to return beneath the next lumber piece with the dogs in a retracted position. Unlike the lumber feeding mechanism of the present invention, this prior feeding mechanism employs an air cylinder whose piston rod is connected to a support for moving one of the dogs and is coupled by an external rack and pinion gear to the second dog for movement thereof in the opposite direction to the first. Unlike the feeding mechanism of the present invention, the dogs of the above-discussed Miller patent are each pivoted to a raised position by a spring until such dogs engage a stop and are pushed downward into a retracted position by a cam action when the dog is returned underneath the support table which pivots the dog against the force of the spring. The present invention employs an actuation motor having an output gear for pivoting the dogs between the raised, or extended, and retracted positions which avoids the use of spring actuated dogs. In addition, while the dogs of the Miller patent are moved to the feed position by an air cylinder, there is no air stop cylinder for engagement with the lumber pieces as they are moved toward the feed position for more accurate positioning in the manner of the present invention.

It has also been proposed in U.S. Pat. No. 4,462,443 of Allen, issued Jul. 31, 1984, to provide a positioning and feeding apparatus for a lumber edger including a pair of clamps which clamp the lumber piece between such clamps before it is fed to the edger and after the piece is scanned with a light scanner to determine a reference axis on the lumber piece for optimum yield of boards. The Allen patent also shows that the clamps are pivoted between a raised position to engage the lumber piece and a retracted position to enable them to pass beneath the lumber and surface of the conveyor by a tilt cylinder. Also a clamp motor is required to rotate a screw drive to move the clamps toward and away from one another. No such clamps, clamp screw motor and tilt cylinder are employed in the feeding mechanism of the present invention. Instead, a simple actuating motor with a rotating output gear is employed to pivot the dogs in the present feeding mechanism. In addition in one embodiment of the feeding mechanism of the present invention, the first and second sets of dogs are mounted alternately above and below the supply conveyor so that when the dogs are pivoted to the retracted position and moved from the feed position to the start position, they travel over opposite sides above and below the lumber piece rather than on the same side of the piece as in both the Allen patent and the Miller patent.

It is shown in U.S. Pat. Nos. 5,011,001 and 5,694,993 both of Cameron, issued Aug. 30, 1991 and Dec. 9, 1997 respectively, to provide an end-dog carriage for moving logs by engagement of the opposite ends of the logs with dogs which clamp the log and move it along a track by means of fluid cylinders. The dogs are pivoted by cylinders mounted on the dog carriages from a retracted position to an extended position and are not moved by actuating motors with a rotating output gear to cause such pivoting in the manner of the present invention.

In addition, U.S. Pat. No. 5,052,885 of Foster, issued Oct. 1, 1991, shows a dual overhead end-dogging system for clamping a log between two dogs which engage the opposite ends of the log and in which the dogs are pivoted from an extended position to a retracted position by a cylinder. However, the end-dog clamping systems of the Foster patent and the Cameron patents are not suitable for engagement with the edges of lumber pieces or flitches to feed them laterally on a supply conveyor to a feed conveyor which conveys the pieces longitudinally to a lumber edger in the manner of the present invention.

As shown in U.S. Pat. No. 4,462,443 of Allen, referred to previously, and in U.S. Pat. No. 4,803,371 of Durland, issued Feb. 7, 1989, it is old to scan lumber pieces with a light scanner to determine a reference axis before such pieces are conveyed to a lumber edger cutting means which cuts the pieces into boards of the proper size for optimum yield of boards.

SUMMARY OF FEATURES OF THE INVENTION

It is therefore one object of the present invention to provide an improved feeding mechanism for feeding lumber pieces, or flitches, in a fast, efficient, and accurate manner for greater production.

Another object of the invention is to provide such a feeding mechanism which employs two sets of first and second dogs which engage different successive boards for moving such boards from a start position on a supply conveyor to a feed position in alignment with a feed conveyor for feeding the lumber pieces into an edger cutting device.

A further object of the invention is to provide such a feeding mechanism in which the first and second dogs are mounted on opposite sides of the lumber piece so that such dogs return from the feed position to the start position on opposite sides of successive pieces to provide a faster and more efficient operation.

An additional object of the invention is to provide such a feeding mechanism in which the dogs are pivoted between a raised, or extended, position and a retracted position by an actuating motor with a rotating output gear and thereby providing a simpler more compact and more trouble-free operation.

Still another object of the invention is to provide such a feeding apparatus in which the actuating motor is an electrical motor which is operated by an electrical control system.

A further object of the invention is to provide the feeding mechanism with an electrical control system including a computer for determining the reference axis for optimum yield of boards from the lumber pieces by scanning such lumber pieces with a light scanner before they are fed on the supply conveyor from the start position to the feed position in order to provide a more efficient apparatus which produces a high yield of useable boards from such lumber.

A still further object of the invention is to provide such a feeding mechanism in which the first and second dogs are moved between the start position and the feed position by separate drive cylinders along separate guides which are fastened together to provide a strong and compact drive mechanism for such dogs.

A still additional object of the invention is to provide such a feeding mechanism in which an air stop cylinder is employed to engage the lumber pieces as they are moved by the dogs toward the feed position for more accurate and faster positioning of the lumber piece in alignment with the feed conveyor for feeding such pieces into the lumber edger.

BRIEF DESCRIPTION OF THE DRAWINGS

Other objects and advantages of the present invention will be apparent from the following detailed description of several embodiments thereof and from the attached drawings of which:

FIG. 3 is an end elevation view of the feeding mechanism of FIG. 1 taken from the left end of FIG. 1;

FIG. 4 is an enlarged view of one of the dogs employed in the feeding mechanism of FIG. 1 showing the actuating motor for pivoting such dog;

FIG. 5 is a vertical section view taken along the line 5—5 of FIG. 1 showing the relative position of the first dog and the second dog which are moved on opposite sides of the lumber pieces above and below such pieces;

DETAILED DESCRIPTION OF SEVERAL EMBODIMENTS

Figure 2:
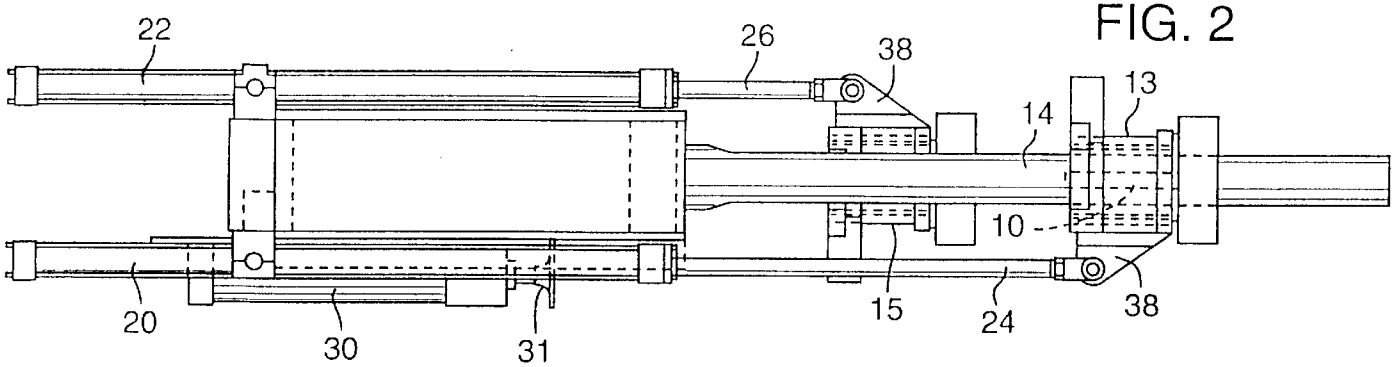
FIG. 2 is a top elevation view of the feeding mechanism of FIG. 1.

As shown in FIGS. 1–5, the lumber feeding mechanism of the present invention includes a first set of dogs 10 and a second set of dogs 12 on dog assemblies 13 and 15 which are mounted for movement along guide rails 14, 16, respectively, and are positioned on opposite sides of a lumber piece, or flitch, 18, with dog assembly 13 above and dog assembly 15 below. A lumber piece, or flitch, will have at least one flat surface. In the illustrations, the lumber pieces 18 are shown having opposed, substantially parallel, flat surfaces on their top and bottom faces (FIGS. 1, 6, 7 and 11).

Figure 1:
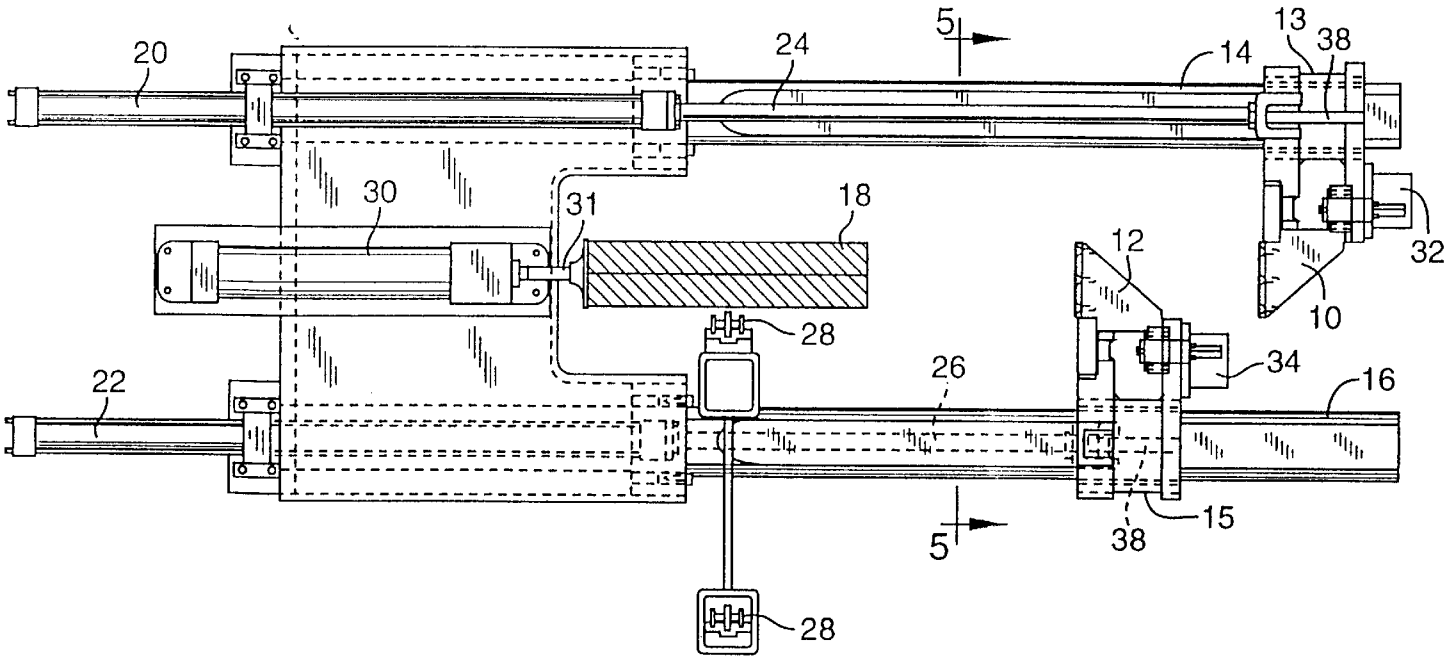
FIG. 1 is a side elevation view of a first embodiment of feeding mechanism of the present invention.

The dogs 10, 12 are moved along guides 14, 16, respectively, by drive cylinders 20, 22, respectively. Thus, the pistons of cylinders 20, 22 are connected to pusher rods 24, 26, respectively, which are attached to the dogs 12, 14 for moving such dogs between a start position on a supply conveyor 52 (shown in FIG. 9) where they first engage the edge of the lumber pieces, or boards 18 (which may be unedged flitches) and a feed position where the boards are moved into alignment with a feed conveyor 28. The boards are engaged by an air-stop cylinder 30 as the boards are moved laterally toward the feed position so that the lumber pieces are stopped in alignment with the feed conveyor 28 as shown in FIG. 1. Thus, the air-stop cylinder 30 has a piston connected stop 31 which engages the lumber pieces to slow and eventually stop their movement at a feed position where they are aligned with the feed conveyor 28 and then releases the lumber pieces to allow them to be conveyed longitudinally along the feed conveyor into the lumber edger cutting device.

Figure 6:
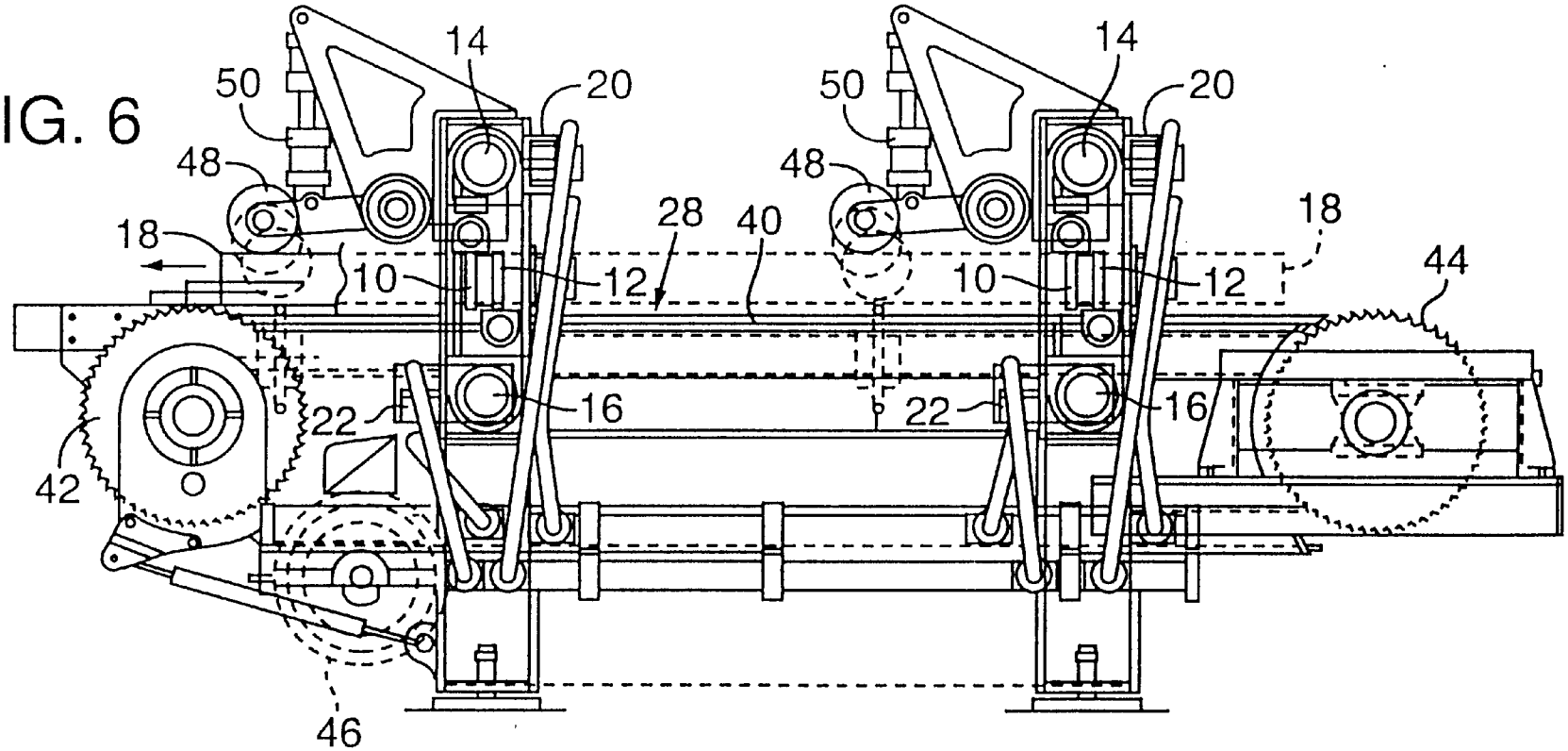
FIG. 6 is an elevation view showing two of the lumber feeding mechanisms of FIGS. 1–5 combined with an edger feeding mechanism for feeding the lumber to the lumber edger cutting device.
Figure 7:
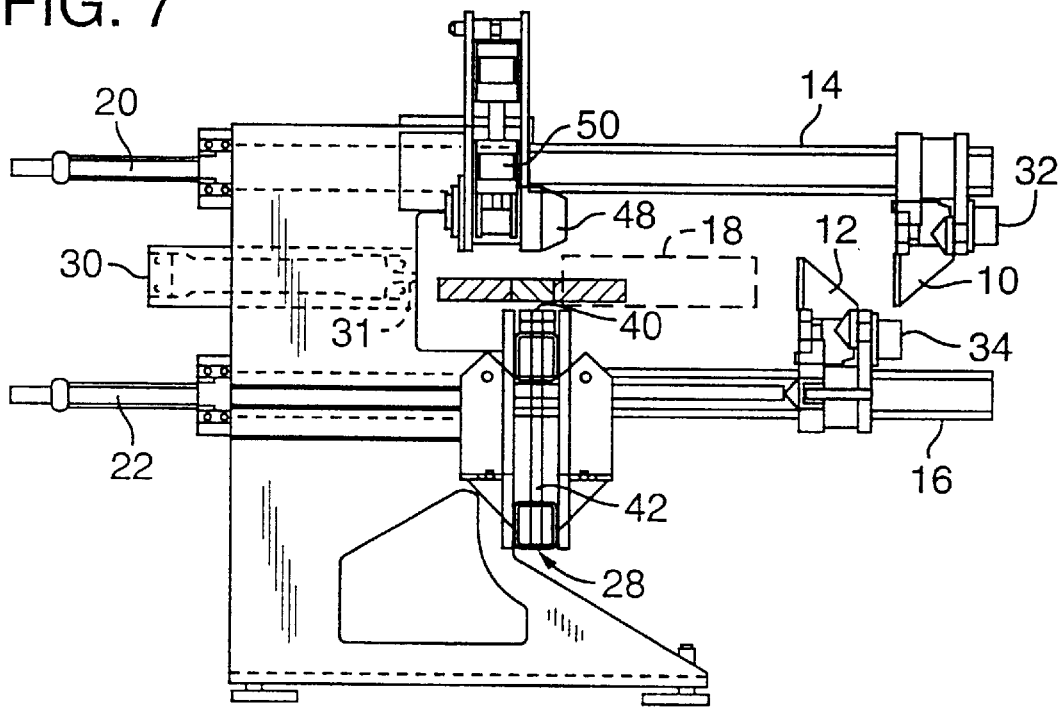
FIG. 7 is an enlarged end view of the right end of the feeding mechanisms of FIG. 6 showing the drive cylinders for moving the dogs along the guiderails and showing the position of the air stop cylinder.
Figure 8:
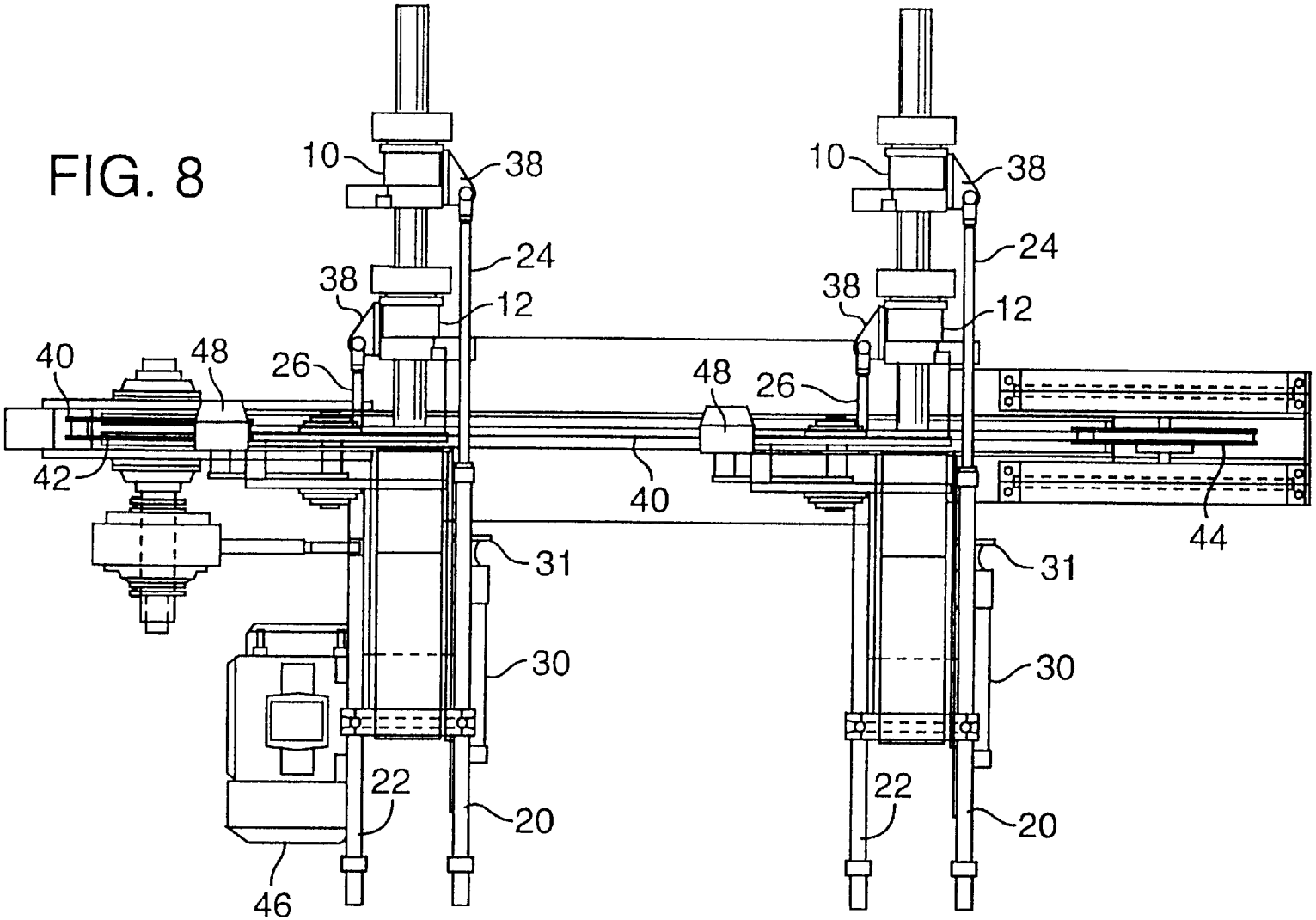
FIG. 8 is a top elevation view of the apparatus of FIG. 6.

As shown in FIGS. 4 and 5, the dogs 10, 12 are each pivoted by an actuator motor 32, 34, respectively, about a pivot axis 36 to move the dogs from the extended position shown in solid lines to the retracted position shown in dashed lines at positions 10', 12'. Preferably, the actuator motors 32, 34 are electric motors having rotating output gears which pivot the dogs 10, 12 about axis 36 through an angle of 90 degrees when such motors are actuated by the electrical control mechanisms shown in FIG. 9. It should be noted that the pusher rods 24, 26 are connected to the assemblies 13, 15 for dogs 10, 12 by connectors 38. As shown in FIGS. 6–8, the lumber feeding mechanism including the dogs 10, 12 feeds the lumber pieces, or flitches, 18 laterally on a supply conveyor 52 shown in FIG. 9, from the start position to the feed position where they are transferred to the feed conveyor 28. The feed conveyor 28 includes a conveyor chain 40 which travels around two end sprockets 42, 44. One of the end sprockets is driven by a drive motor 46 which may be a suitable high-powered electric motor. A pair of pressure rolls 48 are each urged into contact with the top surface of the lumber piece 18 by a pair of cylinders 50 to hold the lumber pieces on the feed conveyor 28 as they are fed longitudinally into a lumber edger 84 shown in FIG. 9. The edger contains a plurality of adjustable cutting saws of conventional type for cutting the edges of the lumber pieces to form boards under the operation of an electrical control system shown in FIG. 9.

Figure 9:
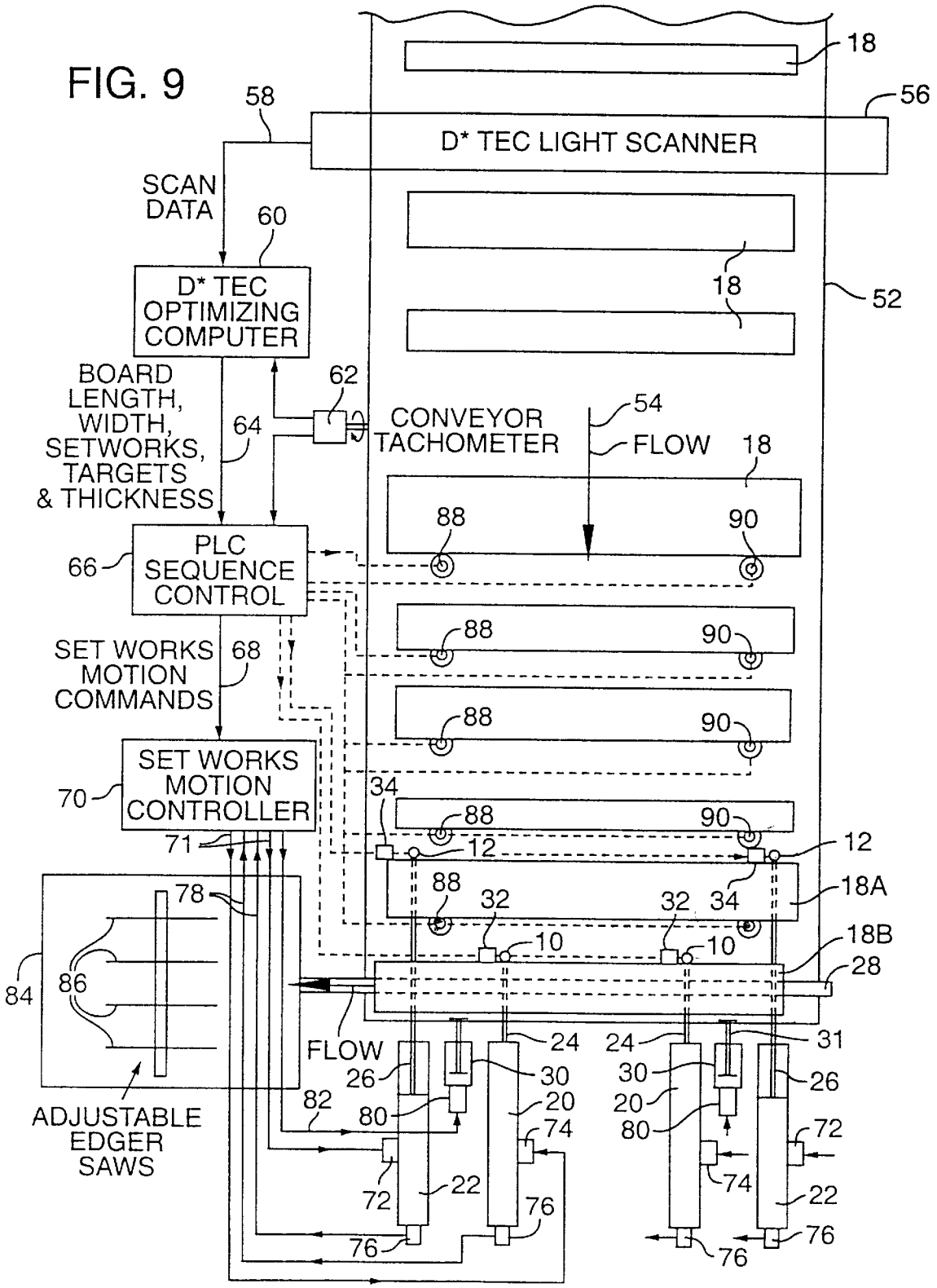
FIG. 9 is a block diagram of an electrical control system including a light scanner for scanning the lumber pieces and a computer for operating the feeding mechanism of FIGS. 1–8.

As shown in FIG. 9, the supply conveyor 52 conveys the lumber pieces 18 laterally along such conveyor in the direction of arrow 54 through a light scanner 56 of the type shown in U.S. Pat. No. 4,803,371 of Durland, issued Feb. 7, 1989, which is hereby incorporated herein by reference. The scanner 56 employs laser light sources which reflect off of the pieces and non-coherent light sources which together produce an output signal on a photodetector camera whose target may be a linear diode array of the charge coupled-diode type (CCD). The light scanner senses the lumber pieces and supplies a scan data signal at output 58 to an optimizing computer 60. The computer also receives an output position signal from the conveyor tachometer 62 which corresponds to the position of the conveyor on which the lumber is conveyed through the light scanner. The computer produces output signals on output 64 corresponding to a reference axis for optimum yield of boards from the lumber including information relating to board length, board width, board thickness. Output signal 64 which is fed to a programmable logic controller 66 (PLC) which also receives an output position signal from the tachometer 62.

The PLC sequence control 66 produces set works motion commands signal at output 68 which are applied to a set works motion controller 70 which controls the operation of the drive cylinders 20, 22 for moving the first dogs 10 and the second dogs 12. Thus, the set works motion controller 70 produces output signals 71 which are applied to servo-valves 72, 74 of the drive cylinders 20, 22 to operate such valves and cause such cylinders to move the pusher rods 24, 26, respectively, connected to the dogs 10, 12. In addition, the cylinders 20, 22 each have linear position feedback transducers 76 which are coupled to the piston rods within such cylinders that move the push rods 24, 26 so that such transducers produce electrical signals indicating the linear position of the piston rod. The output signals of the transducer 76 are fed back to inputs 78 of the setworks motion controller 70 to indicate the position of the push rods and dogs 10, 12. In addition, the two air-stop cylinders 30 have servo-valves 80 which are controlled by output signals 82 of the controller 70 to control the position of the piston stop 31 so that it engages the lumber piece 18 as it is moved from the start position where the dogs 10, 12 first engage the rear edge of the piece. The stop cylinders 30 stop the piece at the feed position where the piece is fed longitudinally on conveyor 28 through the edger 84, as hereafter described. The edger 84 employs a plurality of adjustable edger saws 86 which are adjusted laterally into the proper position for cutting the lumber pieces into boards under the control of the computer system in a conventional manner.

The PLC sequence controller also operates a plurality of pairs of conveyor stops 88, 90 which are, for example, solenoid actuated stops operated by signals produced by the sequence control 66. These stops engage the front or leading edge of the lumber pieces 18 to hold them in alignment on the supply conveyor and to separate them laterally so that the lumber pieces are fed singly on such supply conveyor toward the feed conveyor 28. When the lumber pieces reach a start position 18A, they are engaged at their rear edges by one set of the first dogs 10 or second dogs 12 for moving the piece from the start position 18A to a feed position 18B with the piece in alignment with the feed conveyor 28. The stops 31 of air stop cylinders 30 engage the front edge of the boards as they are moved toward the feed position 18B to slow down the lumber pieces and bring them to a smooth stop at the feed position 18B where they are fed longitudinally by feed conveyor 28 into the edger 14 after being engaged by the hold-down rolls 48 as shown in FIG. 6. Thus, the several sets of stops 88, 90 serve as staging stops to allow the boards to advance laterally on the supply conveyor 52 from the scanner 56 to the edger feed conveyor 28, until the lumber pieces are engaged by the dogs 10 or 12 at the start position 18A and moved to the feed position 18B at which time the stops are retracted below the board by a control signal of the PLC sequence control 66. The drive cylinders 20, 22 are caused to move the dogs 10, 12, respectively, by the output signals 71 of the set-works motion controller 70. It should be noted that the actuator motors 32 for pivoting the first dogs 10 and actuator motors 34 for pivoting the second dogs 12 are each controlled by output signals from the PLC sequence control 66. Thus, the control signals cause the actuating motors to rotate their output gears thereby pivoting the dogs from the lowered position to the raised position at the start position 18A of the lumber piece and pivoting the dogs from the raised position to the retracted position after such piece reaches the feed position 18B. Then the retracted dogs 10, 12 are returned from the feed position to the start position by passing across the opposite sides including the upper face and lower face of the next succeeding lumber piece as shown in FIGS. 4 and 5.

Figure 11:
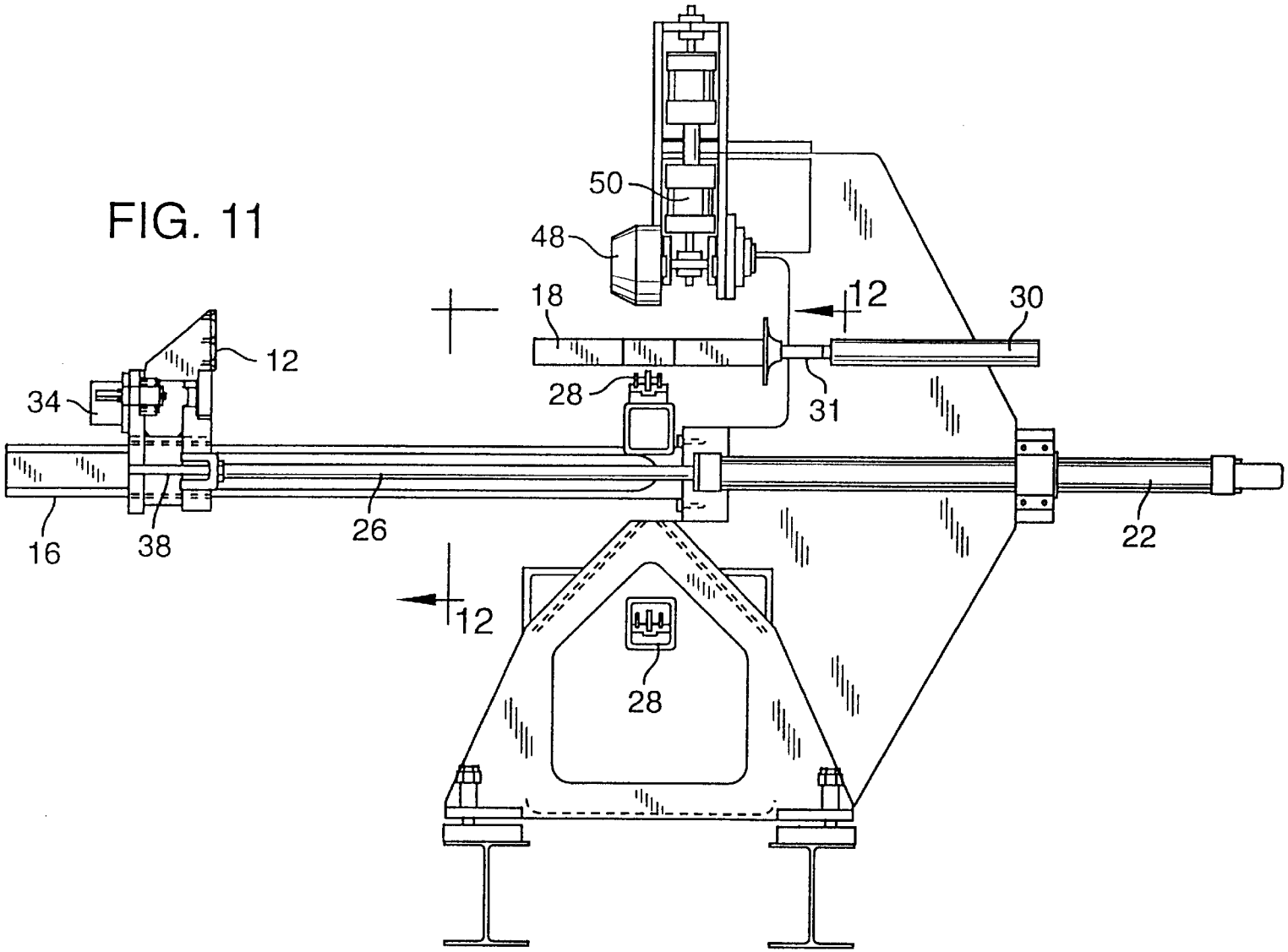
FIG. 11 is a side elevation view of another embodiment of the lumber feeding mechanism of the present invention.
Figure 12:
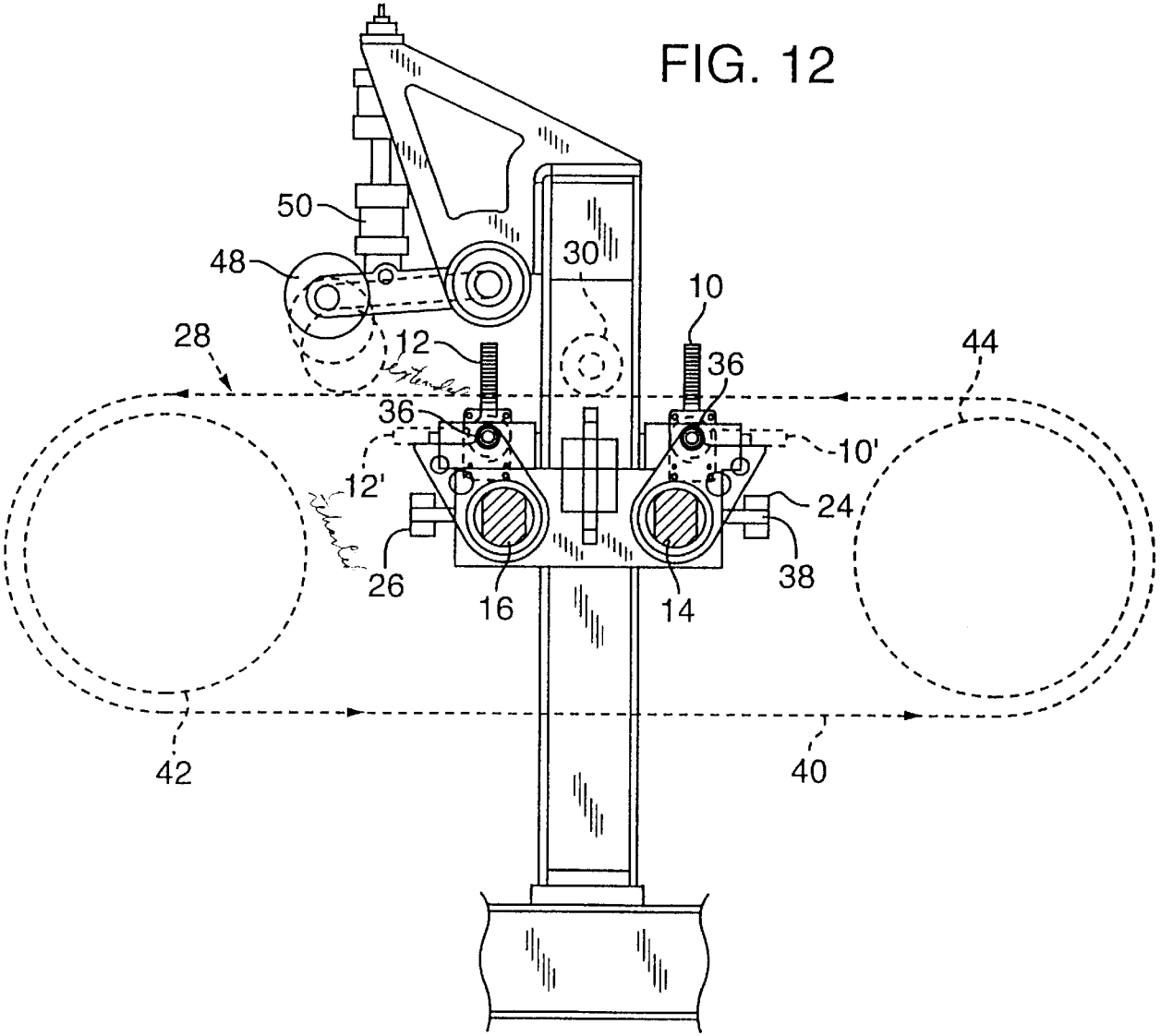
FIG. 12 is a section view taken along the line 12—12 of FIG. 11 showing a pair of first and second dogs which are positioned side-by-side both beneath the lumber piece for pivoting between an extended position for engagement with such piece and a retracted position for returning below the next successive lumber piece.

A second embodiment of the feeding mechanism of the present invention is shown in FIGS. 11 and 12 which is similar to the embodiment of FIGS. 1–9 so that the same reference numbers have been used to designate like parts. However, the second embodiment employs the first dogs 10 and the second dogs 12 in a side-by-side relationship beneath the lumber conveyor so that in the retracted position of the dogs 10', 12', such dogs return from the feed position to the start position across the same side and beneath the next successive lumber piece. Thus as shown in FIG. 12, the first dogs 10 are pivoted 90 degrees about pivot axis 36 from the raised position 10 shown in solid lines to the retracted position 10' shown in dashed lines by the actuating motor associated with such dog. Similarly, the second dog 12 is pivoted 90 degrees from the raised position 12 shown in solid lines to the retracted position 12' shown in dashed lines about the axis 36 by its associated actuator motor 34 which is shown in FIG. 11. As a result, both the first dogs 10 and the second dogs 12 are first pivoted upward into the extended position shown in FIG. 12 by the actuation motor to engage the rear edge of the lumber piece in position to push it laterally along the supply conveyor 52 from the start position 18A to the feed position 18B as shown in FIG. 9. Then the actuation motor pivots the first dogs 10 and the second dogs 12 into the retracted positions 10', 12' to allow the dogs to return from the feed position to the start position beneath the next successive lumber pieces.

Figure 10:
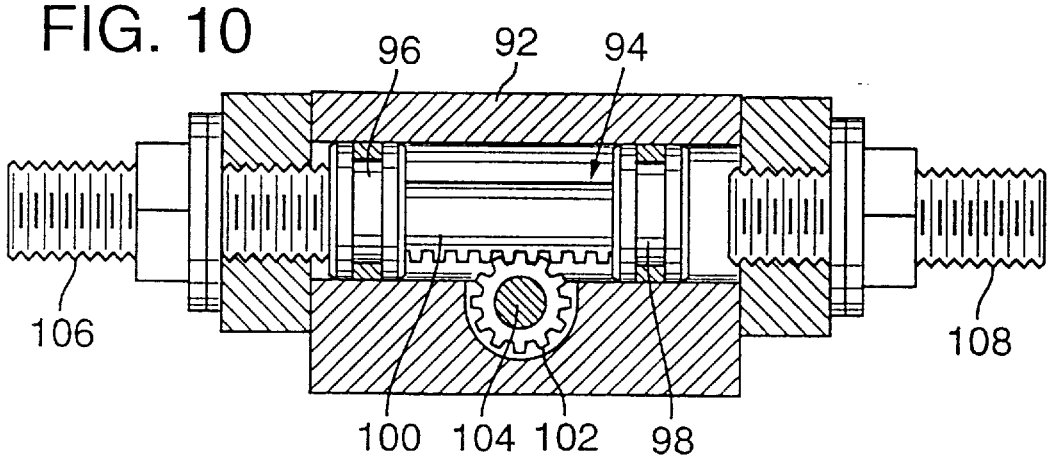
FIG. 10 is an enlarged section view of a portion of an alternative actuator motor in the form of a fluid cylinder motor having an internal rack and pinion to rotate an output gear for pivoting the dogs between a raised position and a retracted position, which can be used in place of the electrical motors shown in FIGS. 1–8.

An alternative actuating motor for pivoting the dogs 10, 12 in the first and second embodiments, is a fluid motor shown in FIG. 10 as including a fluid cylinder 92 containing a modified piston 94 having two sealed piston heads 96, 98 joined by a piston rod 100 which has teeth formed on one side thereof to provide a rack gear which engages an internal pinion gear 102 within the cylinder to rotate the pinion gear about its gear shaft 104. The pinion gear shaft 104 may be coupled directly to one of the dogs to rotate the dog about pivot axis 36 or may be connected to a rotatable output gear which meshes with another gear fastened to a pivot shaft for rotating the dogs about the pivot axis through an angle of approximately ±90 degrees. The opposite ends 106, 108 of the cylinder 92 are connected to sources of fluid pressure by means of a servo-valve (not shown) controlled by the PLC sequence control 66 of FIG. 8 in place of the electric motors 34. Thus, the fluid motor of FIG. 10 can be substituted for the electric motors 32, 34 for actuating the pivoting movement of the dogs 10, 12 in either embodiment of the present invention.

It will be apparent to those having ordinary skill in the art that many changes may be made in the above-described preferred embodiments of the present invention. Therefore, the scope of the present invention should be determined by the following claims.

I claim:

1. Lumber edger feeding apparatus, comprising:

a supply conveyor for conveying lumber pieces, having flat surfaces on their top and bottom faces, laterally as separated lumber pieces which are positioned on the supply conveyor with the front edge of the pieces in a known reference position;

a plurality of feeding dogs including a set of first dogs and a set of second dogs which are selectively moved into engagement with the rear edge of said pieces;

an edger infeed conveyor for conveying the lumber pieces longitudinally through an edger cutting device; and a drive mechanism for moving said first dogs from a start position on said supply conveyor to push a first lumber piece into a feed position aligned with the edger infeed conveyor, for returning said first dogs from said feed position to said start position, for moving said second dogs from a start position on the supply conveyor to push a second lumber piece into said feed position after said first piece is removed from said feed position, and for returning said second dogs from the feed position to said start position, said first dogs and said second dogs returning to said start position on opposite faces of the top and bottom faces of following lumber pieces.

2. Feeding apparatus in accordance with claim 1 in which the drive mechanism includes drive cylinders for moving said first and second dogs from the start position to the feed position and for returning the first and second dogs from the feed position to the start position.

3. Feeding apparatus in accordance with claim 2 in which the drive mechanism also includes a control system for operating said drive cylinders by control signals produced by said control system in response to the output signal of a light beam scanner which scans the lumber pieces to determine their optimum yield axis.

4. Feeding apparatus in accordance with claim 3 which also includes a gas pressure stop operated by the control system so that said stop engages the lumber pieces when they are moved toward the feed position by said cylinders and disengages from the lumber pieces after they reach said feed position.

5. Feeding apparatus in accordance with claim 1 in which the first and second dogs are each moved by an actuation device between a raised position and a retracted position for engagement with the lumber pieces in the raised position of the dogs and for return of the dogs from the feed position to the start position in the retracted position of the dogs.

6. Feeding apparatus in accordance with claim 5 in which the actuation device is an actuation motor which rotates a gear coupled to the dog to pivot the dog between the raised position and the retracted position.

7. Feeding apparatus in accordance with claim 6 in which the actuation motors are electric motors operated by a control signal produced by an electrical control system.

8. Feeding apparatus in accordance with claim 7 in which the edger infeed conveyor feeds the lumber pieces longitudinally through edger saws, and the supply conveyor includes selectively actuated stops which engage the front edge of the lumber pieces when the stops are actuated by the control system.

9. Feeding apparatus in accordance with claim 1 in which the first and second dogs are moved along guides which carry the dogs as they are moved between the start position and the feed position.

10. Lumber edger feeding apparatus comprising:

a supply conveyor for conveying lumber pieces, with at least one flat surface, laterally as separated lumber pieces which are positioned on the supply conveyor with the front edge of the lumber pieces in a known reference position;

a plurality of feeding dogs including a set of first dogs and a set of second dogs which are selectively moved into engagement with the rear edge of said pieces after the dogs are positioned by actuation motors which pivot the first and second dogs to a raised position;

an edger infeed conveyor for conveying the lumber pieces longitudinally through an edger cutting device; and a drive mechanism for moving said first dogs from a start position on said supply conveyor to push a first lumber piece into a feed position aligned with the edger infeed conveyor, for returning said first dogs from said feed position to said start position, for moving said second dogs from a start position on the supply conveyor to push a second lumber piece into the feed position after said first piece is removed form said feed position, and for returning said second dogs from said feed position to said start position, said first and second dogs returning to the start position after pivoting said first and second dogs to a retracted position away from said lumber pieces by said actuation motors which are mounted to be moved with said dogs by said drive mechanism.

11. Feeding apparatus in accordance with claim 10 in which the drive mechanism includes separate drive cylinders for each of said first and second dogs for moving the dogs from the start position to the feed position and returning said dogs from the feed position to the start position.

12. Feeding apparatus in accordance with claim 11 which also includes separate guide members for guiding the movement of said first and second dogs by said drive cylinders.

13. Feeding apparatus in accordance with claim 11 which also includes at least one gas pressure stop that engages the lumber pieces when they are moved to the feed position by said drive cylinders.

14. Feeding apparatus in accordance with claim 13 in which the gas pressure stop is an air cylinder.

15. Feeding apparatus in accordance with claim 10 in which the drive mechanism also includes an electrical control system for operating said drive cylinders and said actuation motors by control signals produced by said control system in response to the output signal of a light beam scanner which scans the lumber pieces to determine their optimum yield axis.

16. Lumber edger feeding apparatus, comprising:

a plurality of feeding dogs for feeding lumber pieces with at least one flat surface to a lumber cutting edger, including a set of first dogs and a set of second dogs;

a plurality of electrical actuation motors for pivoting the first dogs and the second dogs between a retracted position and a raised position for engagement with the rear edges of different lumber pieces in the raised position and away from the lumber pieces in the retracted position; and a drive mechanism for moving said first dogs from a start position to push a first lumber piece into a feed position aligned with the edger, for moving said second dogs from a start position to push a second lumber piece into said feed position after said first piece is removed from said feed position, and for returning said first dogs and said second dogs from said feed position to said start position after the dogs are pivoted to their retracted position away from the lumber pieces by said motors.

17. Feeding apparatus in accordance with claim 16 in which the drive mechanism includes separate drive cylinders for each of said first and second dogs to move said dogs from the start position to the feed position and for returning said dogs from the feed position to the start position.

18. Feeding apparatus in accordance with claim 17 which also includes separate guide members for guiding the movement of the first and second dogs by the drive cylinders.

19. Feeding apparatus in accordance with claim 16 which also includes at least one gas pressure stop that engages the lumber pieces when they are moved to the feed position.

20. Feeding apparatus in accordance with claim 16 in which the actuation motors are mounted for movement with the dogs by the drive mechanism.

* * * * *